US005286913A

United States Patent [19]

Higashi

[11] Patent Number: 5,286,913

[45] Date of Patent: Feb. 15, 1994

[54] MUSICAL TONE WAVEFORM SIGNAL FORMING APPARATUS HAVING PITCH AND TONE COLOR MODULATION

[75] Inventor: Iwao Higashi, Hamamatsu, Japan

[73] Assignee: Yamaha Corporation, Hamamatsu, Japan

[21] Appl. No.: 654,350

[22] Filed: Feb. 12, 1991

[30] Foreign Application Priority Data

Feb. 14, 1990 [JP] Japan ..... 2-31367

[51] Int. Cl.[5] ..... G10H 7/00; G10H 1/06

[52] U.S. Cl. ..... 84/622; 84/630; 84/659; 84/DIG. 26

[58] Field of Search ..... 84/600-603, 84/608, 622-624, 630, 659, 661, DIG. 9, DIG. 10, DIG. 26

[56] References Cited

U.S. PATENT DOCUMENTS 4,130,043 12/1978 Niimi ..... 84/1.03
4,649,783 3/1987 Strong et al. ..... 84/606
4,736,663 4/1988 Wawrzynek et al. ..... 84/627
4,829,463 5/1989 Kakishita et al. ..... 84/DIG. 9 X
4,915,008 4/1990 Sakashita ..... 84/658
4,984,276 1/1991 Smith ..... 84/630 X
4,991,218 2/1991 Kramer ..... 84/622 X
5,212,334 5/1993 Smith, III ..... 84/622

*Primary Examiner*—William M. Shoop, Jr.
*Assistant Examiner*—Jeffrey W. Donels
*Attorney, Agent, or Firm*—Graham & James

[57] ABSTRACT

A musical tone waveform signal forming apparatus having a modulation function comprises a delay loop system including a delay circuit and a filter, a excitation signal input section, a control member and a filter characteristic control circuit. The excitation signal input to the delay loop system circulate therein, so that a musical tone signal is formed. The control member instructs modulation of a musical tone signal. The filter characteristic control circuit changes with time the characteristics of the filter in accordance with an output from the control member. So that pitch modulation accompanied with tone color modulation is effected.

21 Claims, 7 Drawing Sheets

MUSICAL TONE WAVEFORM SIGNAL FORMING APPARATUS HAVING PITCH AND TONE COLOR MODULATION

BACKGROUND OF THE INVENTION

1. Field of the Invention

The present invention relates to a musical tone waveform signal forming apparatus utilized in electronic musical instruments, music education apparatuses, toys, and the like and, more particularly, to a musical tone waveform signal forming apparatus for receiving a musical tone control signal for steadily or time-serially controlling musical tone parameters such as a pitch, a tone color, a tone volume, and the like of a musical tone, and forming a musical tone waveform signal according to the input musical tone control signal.

2. Description of the Prior Art

As an apparatus of this type, an apparatus which utilizes a so-called delay feedback type decay tone algorithm for inputting a nonlinear signal to a delay loop system including a delay circuit to perform feedback arithmetic processing, thereby forming a musical tone signal (to be referred to as a delay feedback type musical tone waveform signal forming apparatus hereinafter) is known (for example, Japanese Patent Laid-Open No. Sho. 63-40199).

The delay feedback type musical tone waveform signal forming apparatus physically approximates mechanical vibration systems of acoustic instruments such as a tube body of a wind instrument, strings of a bowed instrument, and the like by means of an electrical circuit. This apparatus is expected to be able to relatively naturally and faithfully synthesize a tone of a wind instrument or bowed instrument including a change in tone level by inputting a nonlinear signal corresponding to a reed or an embouchure of a wind instrument or a movement of a contact between a bow and a string of a bowed instrument to the delay loop.

However, a delay feedback type musical tone waveform signal forming apparatus which can reproduce a musical tone added with a vibrato effect to have high fidelity to an acoustic instrument has not been realized yet.

SUMMARY OF THE INVENTION

The present invention has been made in consideration of the conventional problems, and has as its object to provide a delay feedback type musical tone waveform signal forming apparatus which can reproduce a musical tone added with a vibrato effect to have high fidelity to an acoustic instrument.

In order to achieve the above object, according to the present invention, a delay feedback type musical tone waveform signal forming apparatus comprising delay loop means including delay means and filter means, and musical tone control signal input means for receiving a musical tone control signal for controlling musical tone parameters of a musical tone to be generated, and a waveform signal outputted from the delay loop means, changing the waveform signal in accordance with the musical tone control signal, and supplying the changed waveform signal to the delay loop means, is characterized in that characteristics of the filter means are changed to modulate a musical tone to be generated.

A conventional delay feedback type musical tone waveform signal forming apparatus comprises a nonlinear section for simulating a mouthpiece of a wind instrument, a mutual effect between a bow and a string of a bowed instrument, or the like, and a linear section for simulating a tube body of the wind instrument, strings of the bowed instrument, or the like. In the linear section, an acoustic loss is substituted with, e.g., a low-pass filter, and the like. It is conventionally considered that a vibrato effect is attained by only frequency modulation. For this reason, the filter characteristics of the low-pass filter, and the like are fixed in units of kinds of musical instruments, or are switched in correspondence with open/close states of tone holes of a wind instrument or strings to be bowed of a bowed instrument. In order to add a vibrato effect, it is proposed to vary a pitch by controlling the number of stages of delay means comprising, e.g., shift registers or memories (RAMs, FIFO memories, or the like) in a digital signal system, or comprising, e.g., BBDs, CCDs, or the like in an analog signal system.

The present inventor found that if a tone color is changed as well as a frequency when a vibrato effect is added, a musical tone approximate to that of an acoustic instrument is obtained, and established the present invention. Japanese Patent Publication No. Hei. 1-15075 filed by the present applicant discloses a modulation effect apparatus which changes a multiplication coefficient in a digital filter to change an output frequency. However, this modulation effect apparatus adds a frequency modulation (vibrato) effect to an input signal (musical tone signal) formed by a separate musical tone forming apparatus and having a predetermined frequency. In addition, this apparatus is not specifically designed to change a tone color. Even if a tone color is changed, a method of forming a musical tone, and a method of adding a vibrato effect are different from those of the present invention, and a method of changing a tone color, the influence of a change in tone color for a musical tone, and the like do not suggest the effects of the present invention.

According to the present invention, in the delay feedback type musical tone waveform signal forming apparatus, as a filter arranged in a delay feedback loop to simulate, e.g., an acoustic loss, a filter whose characteristics can be changed is used, and the characteristics of this filter are changed in accordance with a signal for instructing modulation.

Using a filter causing phase delay according to the phase characteristic as a filter arranged in the delay feedback loop, when its characteristics are changed by the filter coefficient, a phase delay is changed according to the changed phase characteristic, and a total delay time in a loop is changed, thereby changing frequency or pitch of a musical tone to be formed. For example, when an IIR or FIR type digital filter is used as the above-mentioned filter, if a cutoff frequency is changed, phase characteristics are changed in synchronism with the change in frequency, and the frequency or pitch of a musical tone to be formed can be changed. In the conventional apparatus, it is considered that a change in frequency of a musical tone when a tone color is changed is to be corrected or avoided. However, according to the present invention, simultaneous changes in frequency of a musical tone and in tone color as a change in filter characteristics are positively utilized to modulate a musical ton. The relation between a phase characteristic of a filter and frequency of a musical tone in the delay feedback type musical tone waveform signal forming apparatus is written in the U.S. patent application Ser. No. 523,711 filed on May 15, 1990.

Therefore, according to the present invention, since a tone color is appropriately changed as a musical tone is modulated, a modulated musical tone approximate to an acoustic instrument tone can be formed.

DETAILED DESCRIPTION OF THE PREFERRED EMBODIMENT

An embodiment of the present invention will be described in detail hereinafter.

Figure 1:
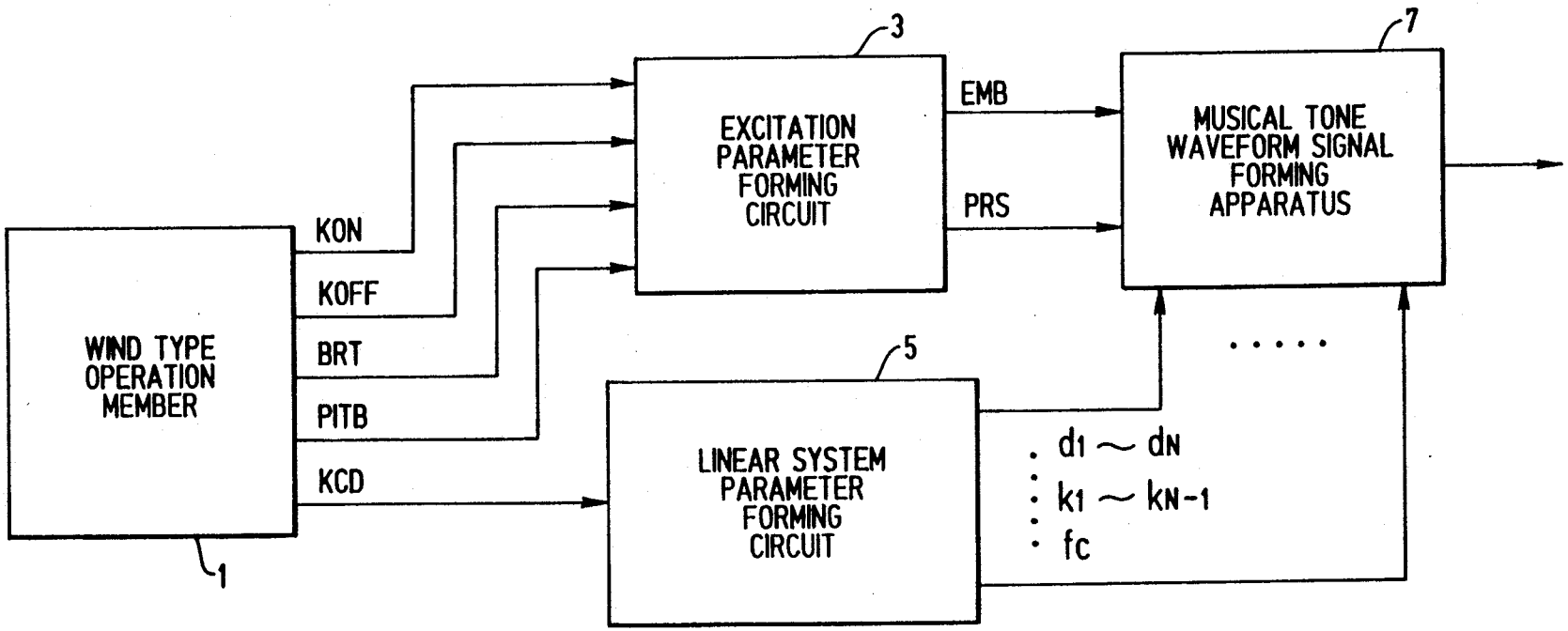
FIG. 1 is a block diagram showing an arrangement of a wind type electronic musical instrument according to an embodiment of the present invention.

FIG. 1 shows an arrangement of a wind type electronic musical instrument comprising a musical tone waveform forming apparatus according to an embodiment of the present invention.

This electronic musical instrument supplies various parameter signals generated by an excitation parameter forming circuit 3 and a linear system parameter forming circuit 5 on the basis of performance data generated by a wind type operation member 1 to a musical tone waveform signal forming apparatus 7, thereby forming a musical tone waveform signal.

Figure 2A:
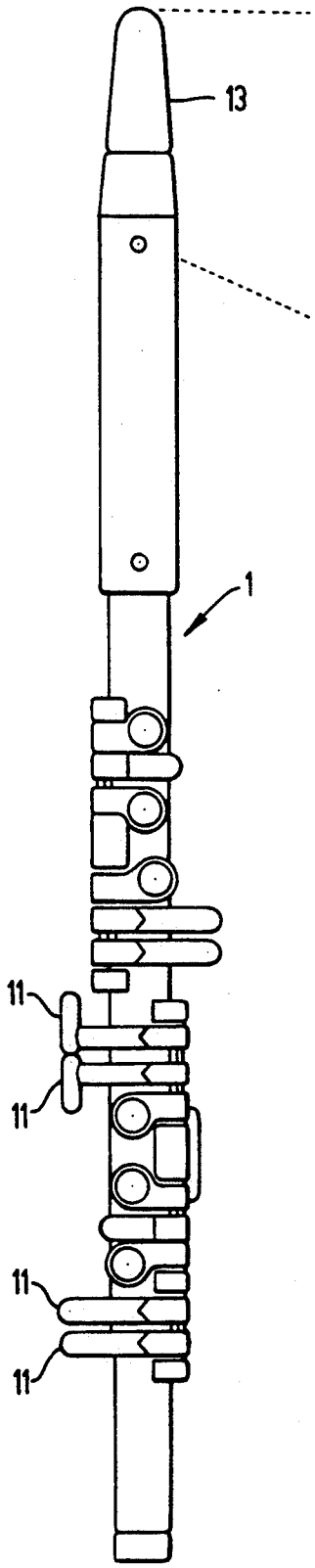
FIG. 2A is a side view of an outer appearance of a wind type operation member shown in FIG. 1.
Figure 2B:
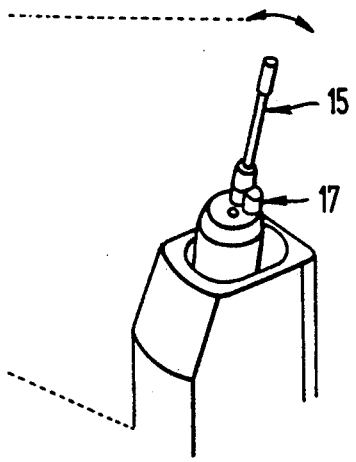
FIG. 2B is a perspective view of a blowing portion in a state wherein a mouthpiece of the wind type operation member shown in FIG. 2A is removed.
Figure 3:
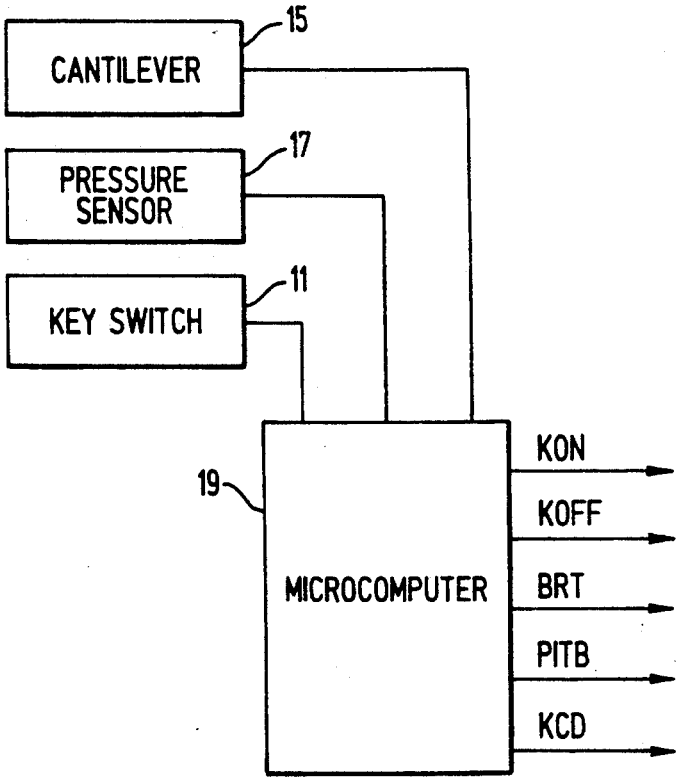
FIG. 3 is a block diagram showing an electrical circuit arrangement of the wind type operation member.

FIG. 2A shows an outer appearance of the wind type operation member 1. As shown in FIG. 2A, the wind type operation member 1 is formed to imitate a clarinet, and has a plurality of keys (key switches) 11 corresponding to keys for opening/closing tone holes of a clarinet. A mouth controller comprising a cantilever 15 for detecting embouchure representing, e.g., a position and a closing state of lips during performance of a wind instrument, and a pressure sensor 17 for detecting a breath pressure during performance of the wind instrument is arranged in a mouthpiece 13, as shown in FIG. 2B. The cantilever 15 is moved in accordance with the shape of lips via a reed, as indicated by an arrow in FIG. 2B, thereby detecting embouchure. The wind type operation member 1 incorporates a microcomputer, as shown in FIG. 3, and outputs performance data such as breath pressure data BRT, the presence/absence of musical tone generation (key ON data KON and key OFF data KOFF), a nominal pitch of a performance musical tone (key code data KCD), a displacement from the nominal pitch of the performance musical tone (pitch bend data PITB), and the like on the basis of outputs from the key switches 11, the cantilever 15, and the pressure sensor 17.

Figure 4:
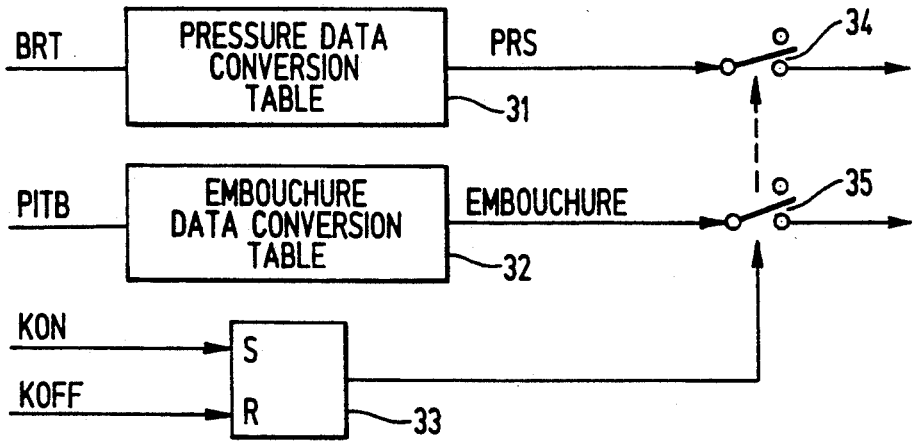
FIG. 4 is a detailed circuit diagram of an excitation parameter forming circuit shown in FIG. 1.

In FIG. 1, the excitation parameter forming circuit 3 receives key ON data KON, key OFF data KOFF, breath pressure data BRT, and pitch bend data PITB of performance data outputted from the wind type operation member 1, and generates an embouchure signal EMB, and a mouth pressure signal PRS on the basis of these data. The circuit 3 supplies the generated signals to the musical tone waveform signal forming apparatus 7. As shown in FIG. 4, the excitation parameter forming circuit 3 may comprise, e.g., a mouth pressure data conversion table 31 for converting a breath pressure signal BRT outputted from the wind type operation member 1 into a mouth pressure signal PRS, an embouchure data conversion table 32 for converting a pitch bend signal PITB into an embouchure signal EMB, a set-reset flip-flop (SR-FF) 33 which is set in response to a key ON signal KON, and is reset in response to a key OFF signal KOFF, a switch 34 which is energized and turned on in response to a set output of the SR-FF 33, a switch is energized and turned on in response to a reset output of the SR-FF 33, and the like. The mouth pressure data conversion table 31 and the embouchure data conversion table 32 in FIG. 4 may comprise multipliers.

Figure 5:
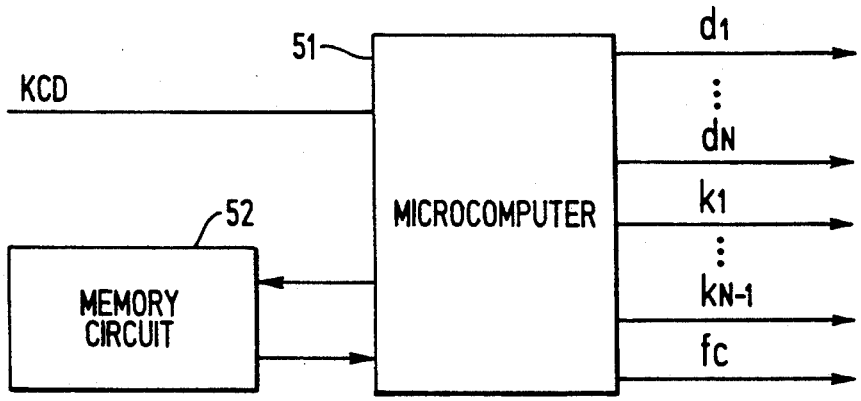
FIG. 5 is a detailed circuit diagram of a linear system parameter forming circuit shown in FIG. 1.
Figure 6:
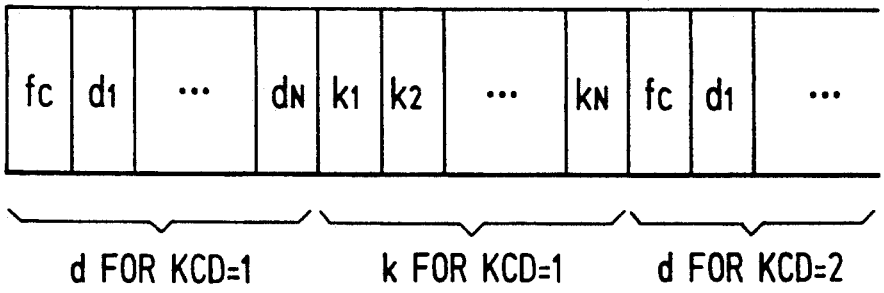
FIG. 6 is a memory map showing a storage content of a memory circuit shown in FIG. 5.

In FIG. 1, the linear system parameter forming circuit 5 receives key code (nominal pitch) data KCD of the performance data outputted from the wind type operation member 1, and generates signals such as delay amounts $d_1, d_2, \ldots, d_N$, multiplication coefficients $k_1, k_2, \ldots, k_{N-1}$, a cutoff frequency $f_c$, and the like. The circuit 5 supplies the generated signals to the musical tone waveform signal forming apparatus 7. As shown in FIG. 5, the linear system parameter forming circuit 5 comprises a microcomputer 51 and a memory circuit 52. The memory circuit 52 stores the cutoff frequency $f_c$, the delay amounts $d_1, d_2, \ldots, d_N$, and the multiplication coefficients $k_1, k_2, \ldots, k_{N-1}$, corresponding to key codes KCD. The microcomputer 51 reads out the contents of the memory circuit 52 on the basis of the key code data KCD outputted from the wind type operation member 1, and outputs the readout contents as the delay amount signals, multiplication coefficient signals, and the cutoff frequency signal.

Figure 7:
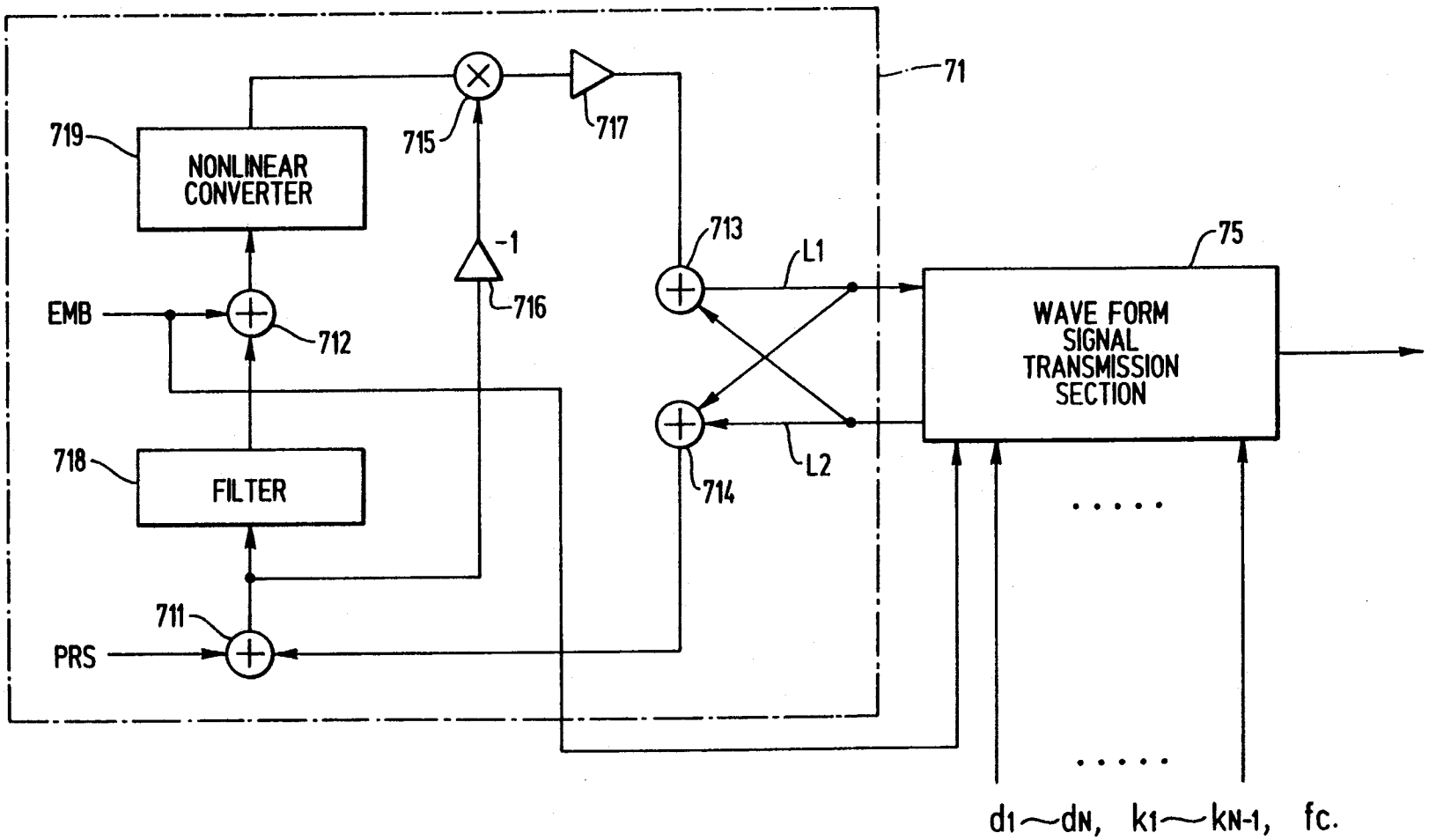
FIG. 7 is a detailed circuit diagram of a musical tone waveform signal forming apparatus shown in FIG. 1.

The musical tone waveform signal forming apparatus 7 comprises a musical tone control signal input section 71 and a waveform signal transmission section 75, as shown in FIG. 7.

The musical tone control signal input section 71 comprises adders 711 to 714, multipliers 715 to 717, a filter 718, and a nonlinear converter 719. The adder 711 adds a waveform signal outputted from the adder 714 serving as an output stage of a backward path of a waveform signal in the waveform signal transmission section 75 and the breath pressure signal PRS, and outputs the sum to the filter 718 and the multiplier 716. Note that a negative sign is given in advance to the breath pressure signal PRS, and the adder 711 serves as a subtractor for subtracting the breath pressure signal PRS from the waveform signal from the adder 714 in practice. The adder 712 adds the output from the filter 718 and the embouchure signal EMB. The nonlinear converter 719 nonlinearly converts the sum outputted from the adder 712 in accordance with predetermined nonlinear characteristics, and outputs the converted output to the multiplier 715. The multiplier 715 multiplies the output from the nonlinear converter 719 and a signal obtained by multiplying the sum outputted from the adder 712 with a multiplication coefficient −1, i.e., a signal obtained by inverting the sum. The multiplier 717 multiplies the product outputted from the multiplier 715 with a predetermined coefficient, and supplies the product to the adder 713 serving as an input stage of a forward path of a waveform signal in the waveform signal transmission section 75. These addition/substraction, multiplication, and nonlinear conversion can simulate, e.g., a formation state of an incident wave into a tube body (resonance tube) caused by a vibration of a reed fixed to an end portion of a mouthpiece of a wind instrument. More specifically, subtraction at the adder 711 represents a state wherein the reed is displaced in accordance with a differential pressure between a breath pressure and a reflection wave pressure propagating into the mouthpiece, and embouchure, and an incident wave is formed in accordance with the displacement. The nonlinear converter 719 represents nonlinear characteristics of bending with respect to a force at the reed, nonlinear characteristics between an air flow passing through the mouthpiece and an air pressure, and the like.

Note that the adder 713 adds the nonlinear signal supplied from the multiplier 717, and a waveform signal supplied from a signal line L2 serving as the backward path of a waveform signal in the waveform signal transmission section 75, and supplies the sum onto a signal line L1 serving as the forward path. The adder 714 adds the waveform signal supplied from the signal line L2, and a waveform signal supplied from the signal line L1, and supplies the sum to the adder 711. Thus, a generation state of a pressure obtained by synthesizing an incident wave caused by an input air flow rate immediately after a gap between the mouthpiece and the reed and a reflection wave from the resonance tube can be simulated.

Figure 8:
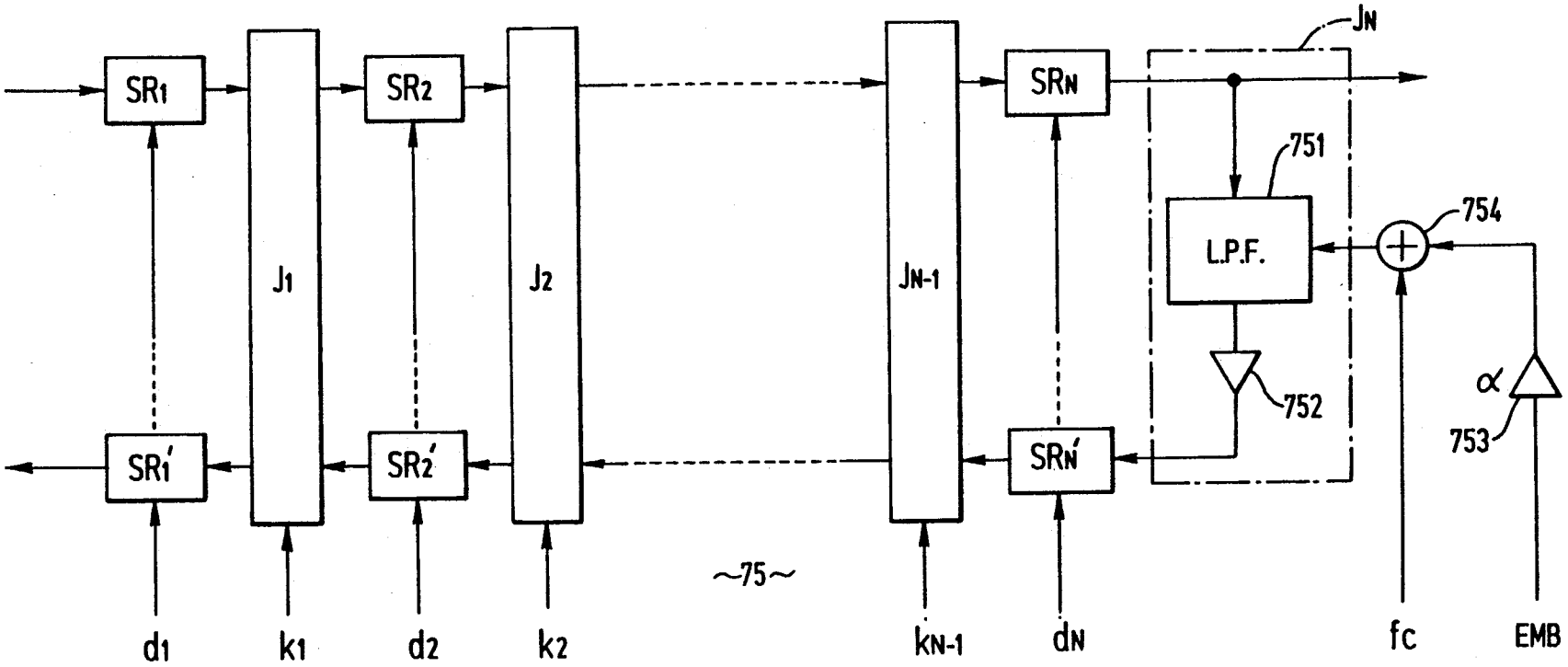
FIG. 8 is a detailed circuit diagram of a waveform signal transmission section shown in FIG. 7.
Figure 9A:
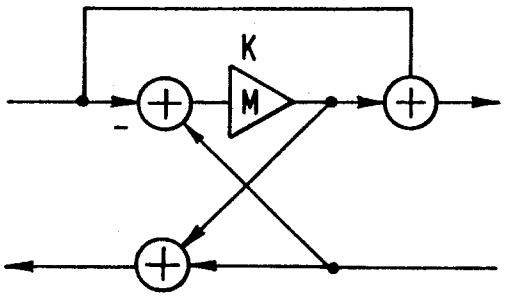
FIGS. 9A to 9C are circuit diagrams showing detailed arrangements of a junction circuit shown in FIG. 8.
Figure 9B:
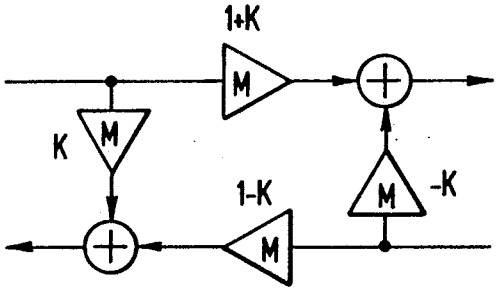
Figure 9C:
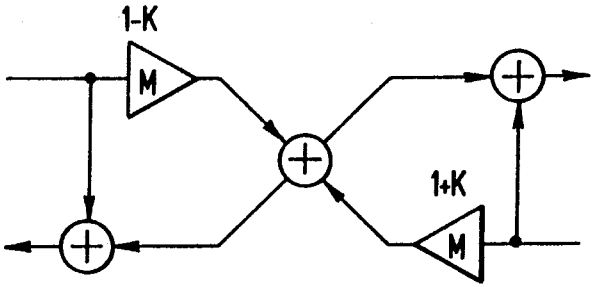

The waveform signal transmission section 75 simulates a tube body (resonance tube) of a wind instrument, and comprises delay circuits (e.g., shift registers) $SR_1$, $SR_1'$, $SR_2$, $SR_2'$, . . . , $SR_N$, and $SR_N'$, junction circuits $J_1, J_2, \ldots J_N$, a low-pass filter (LPF) 751, multipliers 752 and 753, and an adder 754, as shown in FIG. 8. The delay circuits represent the length between the musical tone control signal input section 71 and the junction circuit $J_1$, and the lengths of tubes (e.g., cylindrical tubes) between two adjacent junction circuits $J_{m-1}$ and $J_m$ (where m=1, 2, . . . , N). Each of the junction circuits $J_1$ to $J_{N-1}$ simulates a coupling state of two adjacent cylindrical tubes sandwiching the corresponding junction circuit, and the junction circuit $J_N$ simulates a terminal end (opening end) of the resonance tube. FIGS. 9A to 9C show the arrangements of the junction circuit. In FIGS. 9A to 9C, symbol "+" designates an adder or subtractor for adding data inputted to an input terminal with or without a mark "+", and subtracting data inputted to an input terminal with a mark "−"; and M, a multiplier for multiplying an input signal with a predetermined coefficient. A symbol near each multiplier indicates a coefficient to be multiplied with a signal in the corresponding multiplier. For example, if the junction circuit shown in FIG. 8 employs a Kelly-Rohobaum's lattice structure filter shown in FIG. 9B, sectional areas l and r of cylindrical tubes simulated by delay circuits $SR_m$ and $SR_{m+1}$ on the left and right sides of the junction circuit $J_m$ and a multiplication coefficient k in FIG. 9B satisfy the following relation:

$$k = \frac{r - l}{r + l}$$

Therefore, in this case, the waveform signal transmission section 75 in FIG. 8 simulates a conical resonance tube formed by connecting a plurality of short cylindrical tubes.

In FIG. 8, the LPF 751 simulates an acoustic loss at the opening end of the resonance tube. The characteristics of the LPF 751 are controlled by the cutoff frequency signal $f_c$ outputted from the linear system parameter forming circuit 5, and are also controlled by the embouchure signal EMB outputted from the excitation parameter forming circuit 3. More specifically, the embouchure signal EMB is outputted from the excitation parameter forming circuit 3 as a "+" or "−" signal around 0 as the center, and is supplied to the musical tone control signal input section 71 of the musical tone waveform signal forming apparatus 7. Furthermore, the embouchure signal EMB is multiplied with a coefficient $\alpha$ by the multiplier 753, and the product is added to the cutoff frequency $f_c$ by the adder 754. The output from the adder 754 is given by:

$$f_c' = f_c + \alpha \times EMB$$

The output $f_c'$ is inputted to the LPF 751 as a characteristic control signal. Thus, the cutoff frequency $f_c$ of the LPF 751 varies depending on a signal obtained by scaling the embouchure signal EMB according to the coefficient $\alpha$. Note that the scaling coefficient $\alpha$ may be present or may be varied by a player. Scaling may be key scaling.

In FIG. 8, the multiplier 752 has a multiplication coefficient "−1", and simulates reflection of an acoustic wave at the opening end.

Figure 10:
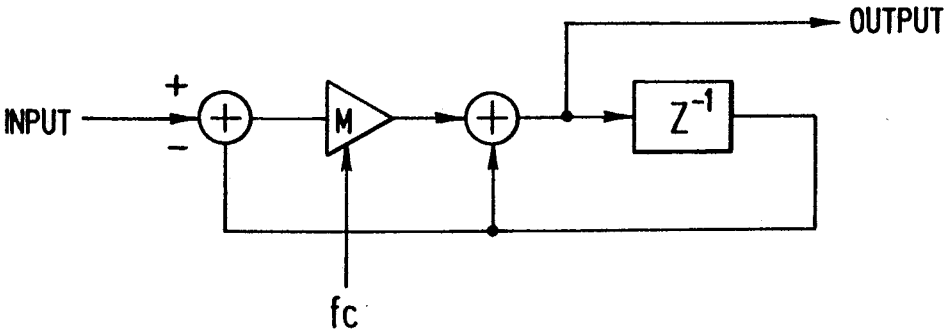
FIG. 10 is a circuit diagram showing a detailed arrangement of the junction circuit shown in FIG. 8.

FIG. 10 shows a detailed arrangement of the LPF 751. FIG. 10 exemplifies an IIR low-pass filter. In FIG. 10, $Z^{-1}$ designates a delay circuit for delaying input data by one period (sampling period) of a sampling pulse. Symbols "+" and M designate an adder/subtractor and a multiplier like in FIGS. 9A to 9C. If a multiplication coefficient of the multiplier M is represented by $\beta$, the LPF shown in FIG. 10 has transfer characteristics given by:

$$H(z) = \frac{\text{output}}{\text{input}} = \frac{\beta}{1 - (1 - \beta)Z^{-1}}$$

That is, the LPF shown in FIG. 10 is a digital primary low-pass filter having characteristics equivalent to those of an analog filter having a Laplacian transfer function given by:

$$H(s) = \frac{\text{output}}{\text{input}} = \frac{a}{a + s} \quad (\text{for } a = 2\pi f_c')$$

Such a filter is disclosed in, e.g., Japanese Patent Laid-Open No. Sho. 61-18212.

The operation of the wind type electronic musical instrument with the above arrangment will be described below. When performance data are supplied from the wind type operation member 1 to the excitation parameter forming circuit 3 and the linear system parameter forming circuit 5, the excitation parameter forming circuit 3 outputs the embouchure signal EMB and the mouth pressure signal PRS on the basis of key ON data KON, key OFF data KOFF, breath pressure data BRT, and pitch bend data PITB of the input performance data, and the linear system parameter forming circuit 5 outputs delay amount signals $d_1, d_2, \ldots, d_N$, multiplication coefficient signals $k_1, k_2, \ldots, k_{N-1}$, and the cutoff frequency signal $f_c$ on the basis of key code data KCD of the performance data. The mouth pressure signal PRS is added to a waveform signal outputted from the waveform signal transmission section 75 via the signal line L2 and the adder 714 by the adder 711 in the musical tone control signal input section 71. This waveform signal represents a reflection wave from the junction circuit $J_N$ at the opening end in the waveform signal transmission section 75. The sum outputted from the adder 711 is supplied to the adder 712 via the filter 718, and is added to the embouchure signal EMB by the adder 712. The sum outputted from the adder 712 is supplied to the nonlinear converter 719, and is nonlinearly converted in accordance with reed characteristics of a wind instrument (e.g., a clarinet). The converted signal is supplied to the waveform signal transmission section 75 via the adder 713 and the signal line L1. Thus, the waveform signal transmission section 75 receives a waveform signal representing an incident wave according to displacement of the reed.

The waveform signal supplied to the waveform signal transmission section 75 is fed back to the adder 711 of the musical tone control signal input section 71 via a delay loop including the delay circuits (e.g., shift registers) $SR_1, SR_1', SR_2, SR_2', \ldots, SR_N$, and $SR_N'$, and the junction circuits $J_1, J_2, \ldots, J_N$. In this case, the waveform signal is delayed according to a total delay time of delay amounts $d_1, d_2, \ldots, d_N$ set in the delay circuits through which the waveform signal passes. In addition, when the waveform signal passes the junction circuit $J_N$, it is modified according to the characteristics of the LPF 751. The total of the delay amounts $d_1, d_2, \ldots, d_N$ set in the delay circuits corresponds to a key code KCD, and determines a fundamental frequency of a performance musical tone. In addition, the ratios of two adjacent ones of the delay amounts $d_1, d_2, \ldots, d_N$, the arrangements of the junction circuits $J_1, J_2, \ldots, J_{N-1}$ and their multiplication coefficients $k_1, k_2, \ldots, k_{N-1}$, and the characteristic of the LPF 751 determine a tone color of a performance musical tone.

The characteristic feature of this embodiment is that the embouchure signal EMB is supplied to the waveform signal transmission section 75 representing the resonance tube, so that the characteristics of the LPF 751 are controlled not only by the cutoff frequency signal $f_c$ for setting a tone color but also by the embouchure signal EMB. The embouchure signal EMB is outputted from the excitation parameter forming circuit 3 as a "+" or "−" signal around 0 as the center. As described above, the embouchure signal EMB is supplied to the musical tone control signal input section 71 of the musical tone waveform signal forming apparatus 7, and is also supplied to the multiplier 753 of the waveform signal transmission section 75 and is multiplied with the predetermined coefficient $\alpha$ by the multiplier 753 to be scaled. Thereafter, the product is added to the cutoff frequency $f_c$ by the adder 754. The LPF 751 receives, as a control signal, the output from the adder 754 given by the following equation, and its cutoff frequency is controlled:

$$f_c' = f_c + \alpha \times EMB$$

When the cutoff frequency of the LPF 751 is changed, its phase characteristics are also changed. Thus, the total delay amount $d_1 + d_2 + \ldots + d_N$ of the delay loop in the waveform signal transmission section 75 is changed by a change in phase characteristics of the LPF 751. As a result, the fundamental frequency of a performance musical tone, i.e., a pitch is changed. The cutoff frequency of the LPF 751 is controlled in this manner, so that the pitch of a performance musical tone can be controlled.

When the cutoff frequency of the LPF 751 is changed, a tone color of a performance musical tone is also changed. However, in the musical tone waveform signal forming apparatus of this embodiment, when the cutoff frequency of the LPF 751 is changed to add a vibrato effect (a frequency or pitch modulation effect), a tone color is appropriately changed. Thus, as compared to a case wherein only a pitch or a tone color is changed, a vibrato musical tone approximate to that of, e.g., a clarinet can be generated.

Figure 11:
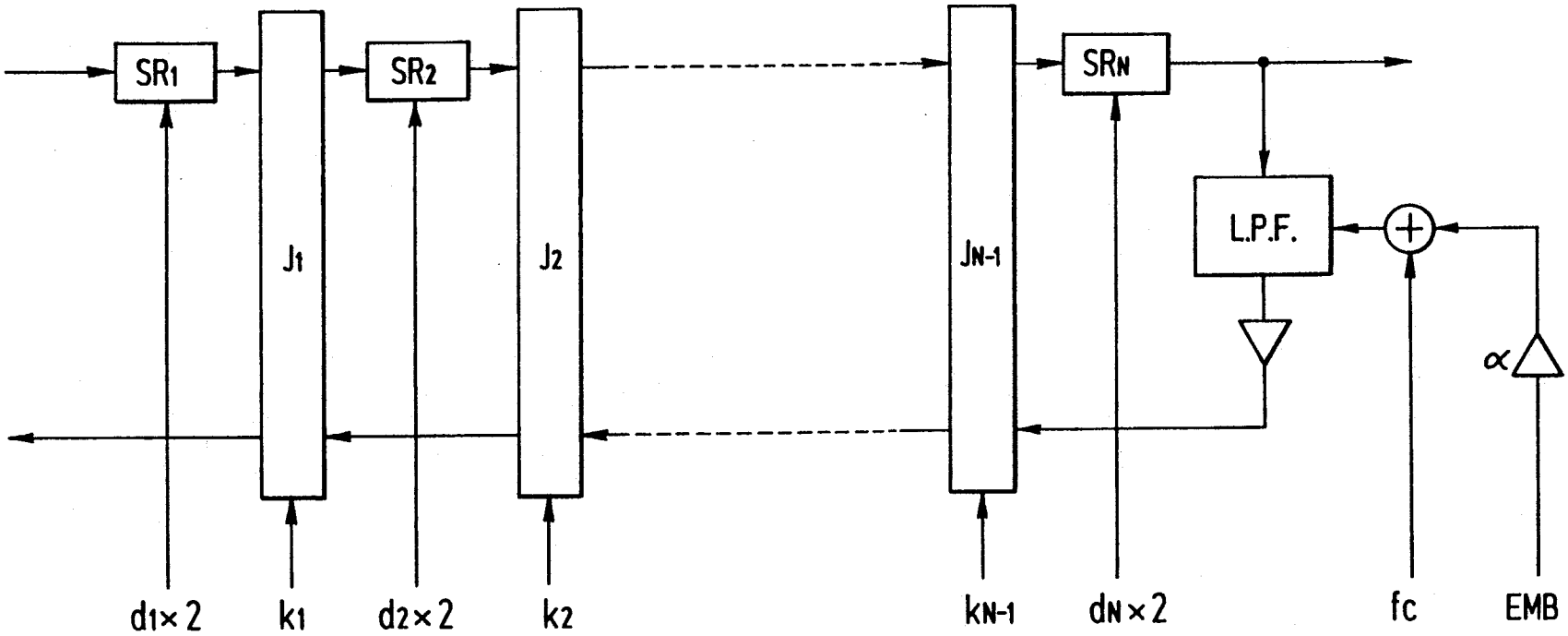
FIG. 11 is a circuit diagram showing a modification of a waveform signal transmission section shown in FIG. 7.

FIG. 11 shows a modification of the waveform signal transmission section 75 shown in FIG. 11. The delay circuits $SR_m$ and $SR_m'$ respectively arranged in forward and backward paths of a bidirectional transmission path, as shown in FIG. 8, are arranged in one of the forward or backward path. The delay amounts of the delay circuits $SR_m$ and $SR_m'$ must be set to be a sum of delay amounts of the forward and backward paths in FIG. 8, i.e., $2 \times d_m$ when it is assumed that the delay times of the forward and backward paths are equal to each other.

[Other Modifications]

The present invention is not limited to the above embodiment, and may be appropriately modified.

For example, the following modifications are available.

(1) A keyboard may be used in place of the wind type operation member.

(2) The breath pressure and pitch bend signals may be inputted from a special purpose operation member, e.g., switches, or may be inputted based on initial or after touch data at a keyboard.

(3) The parameters may be key-scaled.

(4) The contents of the tables may be changed depending on other parameters or may be key-scaled.

(5) The delay circuits may be a RAM or may be other delay means.

(6) The present invention is realized by a wind instrument algorithm in the above description, but may be realized by other algorithms for bowed instruments, percussions, plucked string instruments, and the like.

(7) In the above description, the present invention is realized in a hardware manner but may be realized in a software manner, e.g., by a microprogram.

(8) The present invention is not limited to a digital circuit, but may be realized by an analog circuit.

(9) In the above embodiment, time-divisional multiplex processing may be performed.

(10) A filter arrangement is not limited to an IIR type, but may be any other types as long as they have non-flat phase characteristics.

(11) The filter is not limited to a low-pass filter but may be a filter having other characteristics such as an FIR band-pass filter.

(12) In the above embodiment, the filter is controlled based on an embouchure signal but may be controlled by a breath pressure signal.

(13) The filter may be controlled based on a signal from LFO (low frequency oscillator) or a waveform generator for the modulation effect.

What is claimed is:

1. A musical tone waveform signal forming apparatus having a modulation effect function comprising:

loop means forming a loop and including delay means for delaying a signal input thereto in accordance with a pitch of a musical tone to be generated and filter means for filtering said signal;

excitation means for generating an excitation signal to said loop means based upon an externally provided control signal and a signal output from the loop after delay so that a musical tone signal is formed in said loop means;

control means operated by a player for generating musical tone control information which is variable based on an operation by said player for controlling musical tone parameters including at least one of tone pitch and tone color of said musical tone signal;

filter control means for changing with time a characteristic of said filter means in accordance with variation of said musical tone control information by said player; and output means for outputting from said loop means a musical tone signal having a desired pitch and tone color.

2. A musical tone waveform signal forming apparatus according to claim 1 wherein said control means comprises a wind type control device which detects a state of said player's lip or mouth, and said musical tone control information represents said state.

3. A musical tone waveform signal forming apparatus according to claim 1 wherein, when said operation of said player continuously varies with time, said control means generates said musical tone control information continuously varying with the time, so that said characteristic of said filter means is changed continuously with the time.

4. A musical tone waveform signal forming apparatus according to claim 1 wherein said filter control means comprises filter coefficient generating means for generating a filter coefficient varying with time according to said musical tone control information and providing the filter coefficient to the filter means.

5. A musical tone waveform signal forming apparatus according to claim 4 wherein said filter means imparts phase delay to said signal according to said filter coefficient, so that pitch modulation is effected on said musical tone signal.

6. A musical tone waveform signal forming apparatus according to claim 4 wherein said filter means comprises an infinite impulse response (IIR) type digital filter.

7. A musical tone waveform signal forming apparatus according to claim 4 wherein said filter means comprises a finite impulse response (FIR) type digital filter.

8. A musical tone waveform signal forming apparatus according to claim 4 wherein said filter means comprises a low pass filter, so that pitch modulation and tone color modulation are effected to said musical tone signal.

9. A musical tone waveform signal forming apparatus comprising:

loop means for forming a loop and including delay means and filter means connected to each other, wherein said delay means delays a signal input thereto in accordance a pitch of a musical tone to be generated, said filter means filters said signal delayed by said delay means according to a characteristic determined by a filter coefficient input to said filter means, and said signal filtered by said filter means is fed back to said delay means;

excitation means for generating an excitation signal to said loop means based upon an externally provided control signal and a signal outputted from the loop after delay, so that oscillation of a musical tone signal is started in said loop means; and filter control means for inputting a filter coefficient varying with time to said filter means in response to performance variation by a performer;

output means for outputting from said loop means a musical tone signal having at least one of a desired tone pitch and a desired tone color.

10. A musical tone waveform signal forming apparatus according to claim 9 wherein said filter means imparts phase delay to said signal delayed by said delay means according to said characteristic and said characteristic varies according to said varying of said coefficient, so that pitch modulation and tone color modulation is effected on said musical tone.

11. A musical tone waveform signal forming apparatus according to claim 10 wherein said filter means comprises a infinite impulse response (IIR) type digital filter.

12. A musical tone waveform signal forming apparatus according to claim 10 wherein said filter means comprises a finite impulse response (FIR) type digital filter.

13. A musical tone waveform signal forming apparatus according to claim 9 wherein said filter means comprises a low pass filter, so that pitch modulation and tone color modulation are effected on said musical tone signal.

14. A musical tone waveform signal forming apparatus according to claim 9 further comprising a wind type operation member for detecting a state of player's lip or mouth, wherein said filter control means varies said filter coefficient according to said state of player's lip or mouth detected by said operation member.

15. A musical tone waveform signal forming apparatus comprising:

delay means for delaying a signal input thereto;

filter means for filtering said signal delayed by said delay means, and imparting phase delay to said signal according to a phase characteristic which is determined by a filter coefficient input to said filter means, wherein said delay means and said filter means are connected in a loop;

excitation means for receiving an external control signal and an output from the loop, forming an excitation signal in response thereto, and providing the excitation signal to said loop, so that a musical tone signal is formed in said loop; and filter control means for inputting said filter coefficient varying with time to said filter, whereby said phase characteristic is varied with the time, and the pitch of said musical tone signal is varied with the time in accordance with said varying of said filter coefficient.

16. A musical tone waveform signal forming apparatus according to claim 15 wherein said filter means comprises a infinite impulse (IIR) type digital filter.

17. A musical tone waveform signal forming apparatus according to claim 15 wherein said filter means comprises a finite impulse response (FIR) type digital filter.

18. A musical tone waveform signal forming apparatus according to claim 15 wherein said filter means comprises a low pass filter, so that pitch modulation and tone color modulation are effected to said musical tone signal.

19. A musical tone waveform signal forming apparatus according to claim 15 further comprising a wind type operation member for detecting a state of player's lip or mouth, wherein said filter control means varies said filter coefficient with time according to said state of player's lip or mouth detected by said operation member.

20. A musical tone waveform signal forming apparatus according to claim 1, wherein said externally provided control signal is generated in accordance with said musical tone control information.

21. A musical tone waveform signal forming apparatus according to claim 9, wherein said externally provided control signal is generated in accordance with said performance variation, and said filter control means generates filter coefficients on the basis of the control signal.

* * * * *